United States Patent [19]

Fukuda et al.

[11] 4,360,723

[45] Nov. 23, 1982

[54] MICROWAVE OVEN

[75] Inventors: Norisuke Fukuda, Tokyo; Leo Mori, Yokohama, both of Japan

[73] Assignee: Tokyo Shibaura Denki Kabushiki Kaisha, Kawasaki, Japan

[21] Appl. No.: 200,032

[22] Filed: Oct. 23, 1980

[30] Foreign Application Priority Data

Oct. 31, 1979 [JP] Japan ..... 54-140671
Jun. 30, 1980 [JP] Japan ..... 55-88806

[51] Int. Cl.[3] ..... H05B 6/68

[52] U.S. Cl. ..... 219/10.55 B; 219/10.55 R; 374/128

[58] Field of Search ..... 219/10.55 B, 10.55 R, 219/10.55 M, 10.55 F; 73/355 R, 355 EM

[56] References Cited

U.S. PATENT DOCUMENTS 4,049,938 9/1977 Ueno ..... 219/10.55 R
4,191,876 3/1980 Ohkubo et al. ..... 219/10.55 B

FOREIGN PATENT DOCUMENTS 2917033 11/1979 Fed. Rep. of Germany .. 219/10.55 B 54-2556 1/1979 Japan ..... 219/10.55 B
54-142639 11/1979 Japan ..... 219/10.55 B

*Primary Examiner*—Arthur T. Grimley

*Attorney, Agent, or Firm*—Oblon, Fisher, Spivak, McClelland & Maier

[57] ABSTRACT

A microwave oven comprising a magnetron for emitting microwaves; a heating chamber body for holding food being heated by microwaves from the magnetron; an infrared ray transmitting section provided in the top wall of the heating chamber body for transmitting infrared rays emitted from the food; an infrared ray detecting device disposed over the infrared ray transmitting section and comprising a horn member and an infrared ray detecting element, the horn member being made of material capable of cutting off microwaves and having a hollow extending toward the heating chamber body into which infrared rays are applied from the food and the infrared ray detecting element being so positioned as to detect infrared rays condensed by the hollow, the hollow having a diameter increasing toward the heating chamber body and a minimum opening size smaller than the wavelength of microwaves and having a spread angle so set that only infrared rays emitted from the food may be allowed to reach the infrared ray detecting element and that infrared rays emitted from other regions than the food may be returned after repeated reflection within said hollow without being applied to the infrared ray detecting element; and a processing circuit for calculating the temperature of the food on the basis of a detection signal from the infrared ray detecting device.

16 Claims, 11 Drawing Figures

MICROWAVE OVEN

This invention relates to a microwave oven incorporating an infrared detecting device.

For the effective operation of a microwave oven, it is essential to grasp and suitably adjust the temperature of food being heated. Conventionally, there are generally known microwave ovens incorporating infrared detecting devices for detecting the heating temperature of food. These detecting devices can detect the food temperature without touching the food.

In such prior art microwave ovens incorporating the infrared detecting devices, the intensity of infrared rays received decreases in proportion to the square of the distance between a detector and the food being heated. In order to detect correct infrared ray intensity, therefore, such decrease need be corrected. Various correcting means have so far been provided for this purpose, though they generally have been complicated in structure.

Also, there has been proposed a system to condense infrared rays from the food being heated by using lenses and reflectors. Such system could not ensure high-reliability temperature detection since it would use a high-frequency heating source whose high-frequency energy might possibly cause wrong operation of the detector or contamination of the optical system. Besides, with such system, the detecting device would be complicated in construction and hence increased in cost.

This invention is contrived in consideration of the aforementioned circumstances, and has an object to provide a microwave oven of simple construction capable of high-reliability, high-accuracy control of heating temperature.

Another object of the invention is to provide a microwave oven provided with a simple-structure temperature sensor capable of high-reliability, high-accuracy detection of the temperature of food being heated.

Still another object of the invention is to provide a microwave oven provided with a simple-structure infrared detector capable of high-reliability, high-accuracy detection of infrared rays from food being heated.

According to the invention, there is provided a microwave oven comprising a magnetron emitting microwaves, a heating chamber body holding food being heated, an infrared transmitting section to transmit infrared rays from the food being formed in the top wall of the heating chamber body, infrared detecting means disposed over the infrared transmitting section, the infrared detecting means including a horn member disposed at the upper portion of the infrared transmitting section and formed of material capable of cutting off microwaves, the horn member having a hollow which extends toward the heating chamber body, has its diameter increasing toward the heating chamber body, and has its minimum opening size smaller than the wavelength of microwaves, and an infrared detecting element to detect infrared rays condensed by the hollow, the hollow having a spread angle so set that only infrared rays emitted from the food being heated may be allowed to be applied to the infrared detecting element and that infrared rays emitted from other regions than the food may be returned after repeated reflection within the hollow, and a processing circuit for calculating the temperature of the food being heated on the basis of a detection signal provided by the infrared detecting means.

This invention can be more fully understood from the following detailed description when taken in conjunction with the accompanying drawings, in which:

FIG. 1 is an exterior view of an embodiment of the microwave oven of this invention;

FIG. 2 schematically shows the internal structure of the microwave oven shown in FIG. 1;

Figure 1:
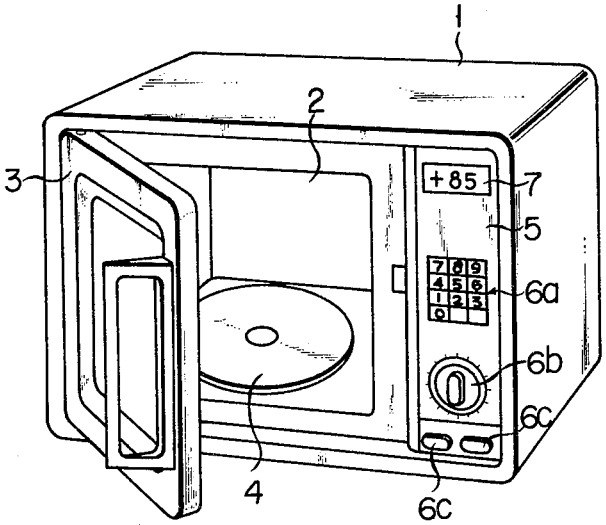
FIG. 1 is an exterior view of an embodiment of the microwave oven of this invention.

In FIG. 1, a heating chamber 2 is defined inside a main body 1 of the microwave oven, and a door 3 is attached to the front of the heating chamber 2. At the bottom of the heating chamber 2, there is a turntable 4 which is to carry food to be heated and to rotate. A control panel 5 is attached to one side of the front of the main oven body 1. On the control panel 5, there are arranged various factors or control switches **6*a*, 6*b* and 6*c* to set the heating conditions including heating energy level, heating time, etc., and a temperature indicator 7** to indicate the temperature of the food being heated sensed by an infrared detecting device mentioned later.

Figure 2:
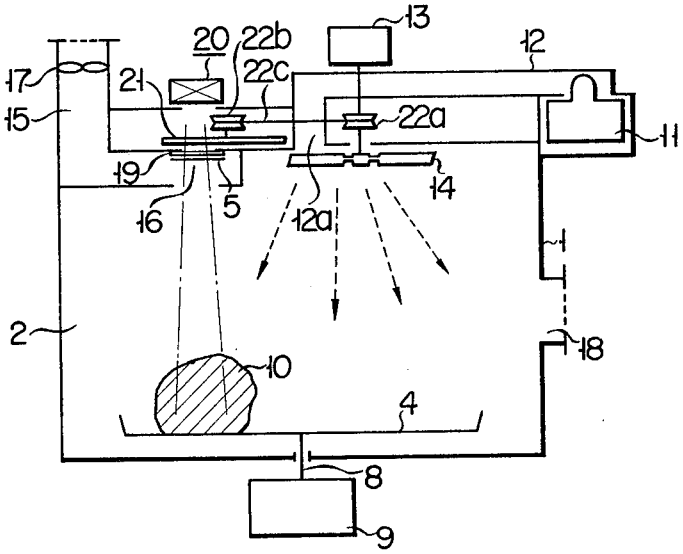

FIG. 2 schematically shows the interior of the main body of the microwave oven shown in FIG. 1.

As shown in FIG. 2, the turntable 4 is coupled with a motor 9 by means of a rotating shaft 8 which extends through the bottom wall of the heating chamber 2. A material or food 10 to be heated is put on the turntable 4. A magnetron 11 as a high-frequency heating source is disposed at the upper portion of the interior of the main oven body. The motor 9 is driven when the magnetron 11 is energized to deliver microwaves (radio-frequency waves), and the food 10 on the turntable 4 rotated by the motor 9 is heated by the microwaves from the magnetron 11.

Meanwhile, the microwaves delivered from the magnetron 11 are led into an antenna opening **12*a* defined at the upper portion of the heating chamber 2 by means of a waveguide tube 12. A stirrer fan 14 to be rotated by the motor 13 is disposed near the antenna opening 12*a*, and the microwaves led from the magnetron 11 through the waveguide tube 12 into the antenna opening 12*a* are stirred by the action of the fan 14. Thus, the microwaves are radiated uniformly throughout the interior of the heating chamber 2. Consequently, the to-be-heated food 10 on the turntable 4** are subjected to the uniform radiation of the microwaves across the whole surface thereof, so that it will be heated all over the surface without partial unevenness.

At the upper portion of the interior of the main oven body 1, moreover, there is an air conduit 15 defined by part of the top wall of the heating chamber 2 and communicating with an air inlet 16 formed at the upper portion of the heating chamber 2 which constitutes the conduit 15. The open air is introduced into the air conduit 15 by operating a blower fan 17 which is disposed inside the air conduit 15, and is led into the heating chamber 2 via the air inlet 16. A downward airstream is created within the heating chamber 2 by the introduced air. By this airstream, steam and other materials emitted from the food 10 by its exposure to the microwaves are discharged through an exhaust port 18 in one side wall of the heating chamber 2.

An infrared transmitting membrane 19 capable of transmitting infrared rays is attached to that wall of the air conduit 15 which faces the air inlet 16. The infrared transmitting membrane 19 is formed of e.g. a nylon film or acrylic resin. The infrared detecting device 20 is disposed over the infrared transmitting membrane 19. The infrared detecting device 20 senses infrared rays that are emitted from the food 10 when the microwaves are applied to the food 10. A light chopper 21 is interposed between the infrared detecting device 20 and the infrared transmitting membrane 19. The chopper 21, which is coupled with the motor 13 by means of pulleys 22*a* and 22*b* and a belt 22*c*, is rotated by the driving force of the motor 13 so as to intercept at suitable regular intervals infrared rays transmitted through the air inlet 16 and the infrared transmitting membrane 19 out of the infrared rays emitted from the food 10. The infrared rays transmitted through the chopper 21 are applied to the infrared detecting device 20.

The chopper 21 is composed of a disc which is painted black on one side to have an infrared emissivity of approximately 1 and has an infrared reflector formed on the other side. Such disc chopper 21 is disposed so that the side thereof on which the infrared reflector is formed may face the incidence side or the food 10. Further, the chopper 21 has notches or slits formed at equal spaces along the circumferential direction so that the chopper 21, when rotated, may intercept the incident infrared rays at a duty of 50%. The 50% duty suggests that the circumferential width of each notch or slit is equal to the circumferential space between each two adjacent notches or slits. The infrared rays intermittently intercepted and alternated by the chopper 21 are led to the infrared detecting device 20.

Figure 3:
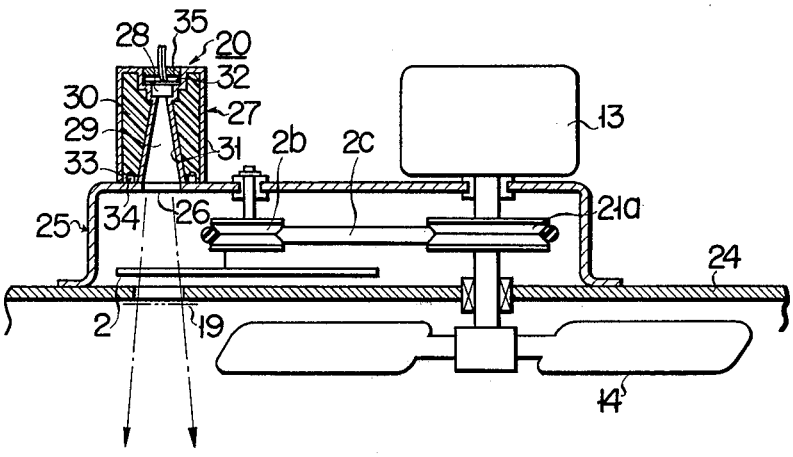
FIG. 3 shows in detail the principal part of the microwave oven shown in FIGS. 1 and 2.

FIG. 3 shows only the principal part of the microwave oven of this invention mainly including the infrared detecting device 20, the chopper 21, and a driving system for the chopper 21.

In FIG. 3, a plate member 25 with a U-shaped cross section is mounted on the top wall 24 of the heating chamber 2. The plate member 25 supports the motor 13 and the pulleys 22*a* and 22*b*. A hole 26 is defined at that portion of the plate member 25 which faces the infrared transmitting membrane 19. A horn member 27 is disposed over the hole 26 of the plate member 25. A stepped recess 32 is formed at the top portion of the horn member 27, and an infrared detector 28 is disposed in the recess 32. The horn member 27 and the infrared detector 28 constitute the infrared detecting device 20. In the horn member 27, a hollow 29 in the shape of e.g. a truncated cone outwardly increasing its diameter extends along the longitudinal direction of the horn member 27 so that the open end (maximum diameter side) of the hollow 29 may face the plate member 25. Further, the minimum opening size of the hollow 29 is set smaller than the wavelength of microwaves lest the microwaves should enter the hollow 29. The horn member 27 is composed of a main horn body 30 formed of synthetic resin such as ABS (acrylonitrile-butadiene-styrene copolymer) resin and a specularly polished high-frequency shield member 31 formed of plating or other coating covering the whole surface of the main horn body 30.

The recess 32 coaxially communicates with the truncated narrow portion of the hollow 29 of the horn member 27 on the opposite side thereof to the maximum diameter side. The recess 32 has a stepped configuration including a smaller-diameter portion adjacent to the truncated narrow portion of the hollow 29 and a large-diameter portion extending from the smaller-diameter portion to the outside of the horn member 27. The infrared detector 28 is fitted in the stepped recess 32. The infrared detecting device 20 composed of the horn member 27 and the infrared detector 28 attached to the horn member 27 is fixed by fitting a projection 34 protruding from the plate member 27 in an E-tap formed in the peripheral surface of the horn member 27 on the open end side or maximum diameter side of the conical hollow 29. A cover member 35 is fitted in the upper portion of the stepped recess 32 with the infrared detector 28 contained therein. The existence of the cover member 35 prevents the microwaves from penetrating the infrared detector 28 from the opposite side thereof to the food 10 to be heated.

The infrared detecting device 20 is connected with a signal processing circuit 41 (see FIG. 6) contained in the main oven body 1, and a detection signal from the detecting device 20 is supplied to the processing circuit 41 to be processed thereat.

With the microwave oven incorporating the infrared detecting device 20 of the above-mentioned construction, penetration of noise into the infrared detector 28 can greatly be reduced, so that only the infrared rays emitted from the food 10 may be practically detected.

Figure 4A:
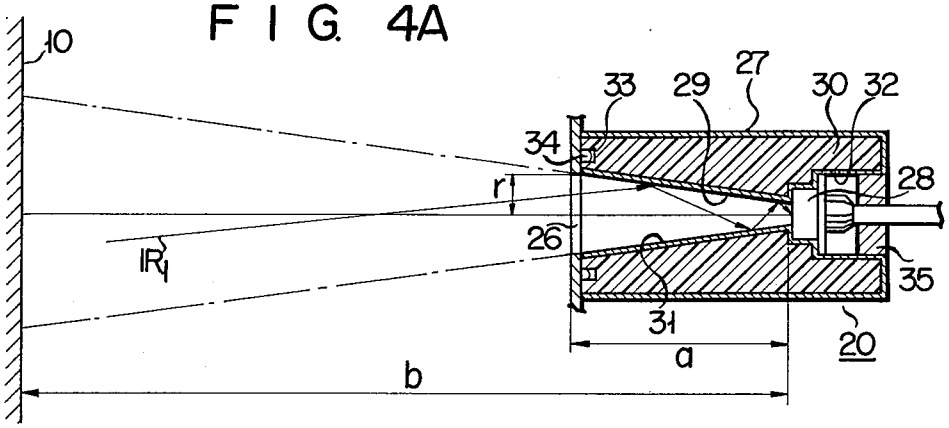
FIGS. 4A and 4B show the structure of an infrared detecting device incorporated in the microwave oven of FIGS. 1 to 3.
Figure 4B:
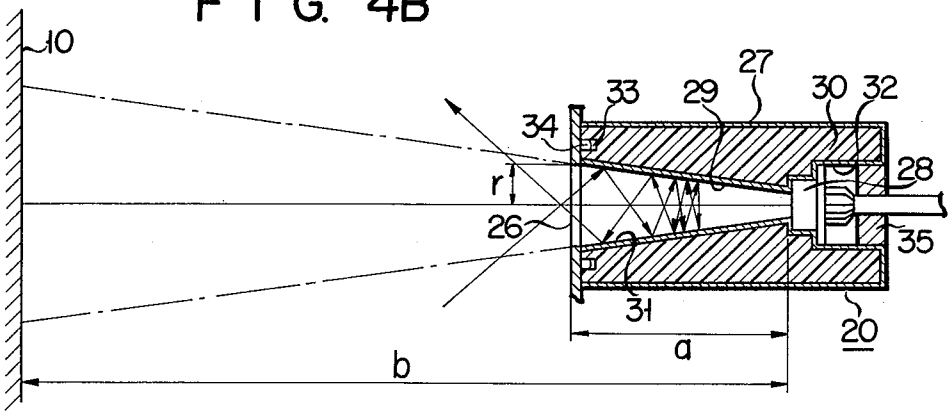

The above effect is attributable to a fact that the field of view of the infrared detecting device 20 is defined in accordance with the spread angle of the conical hollow 29 since the horn member 27 of the infrared detecting device 20 is so disposed that the conical hollow 29 having outwardly increasing diameter may face the heating chamber side. In other words, the range of detection field can be defined effectively. Referring now to the drawings of FIGS. 4A, 4B and 4C, these circumstances will be described in detail. Besides the infrared rays emitted from the food 10, infrared rays emitted from various parts of the inside wall portion of the heating chamber 2 exposed to the microwaves are led into the conical hollow 29 of the horn member 27. Accordingly, if all the infrared rays introduced into the hollow 29 would be detected by means of the infrared detector 28, the detected data should involve errors, prohibiting accurate detection of the temperature of the food 10 being heated. For accurate temperature detection, therefore, it is necessary that infrared rays other than those which are emitted from the food 10 and constituting erroneous elements be prevented from being applied to the infrared detector 28 inside the stepped recess 32 at the top of the horn member 27. According to this embodiment, the prevention of the incidence of the infrared rays constituting the erroneous elements upon the infrared detector 28 is achieved in accordance with the following principle. Namely, as shown in FIG. 4A, an infrared ray IR1 applied from within the spread angle region of the hollow 29 of the horn member 27 are reflected by the inside wall surface of the hollow 29 to be applied to the infrared detector 28. As shown in FIG. 4B, on the other hand, an infrared ray IR2 applied from outside the spread angle region is returned to the open end side of the hollow 29 as it is reflected in zigzags within the hollow 29, failing to reach the infrared detector 28. Thus, only the infrared rays applied only from within the spread angle region of the hollow 29 are allowed to fall upon the infrared detector 28, and the infrared rays from other regions than the spread angle region are prevented from being applied to the detector 28. In consequence, by suitably setting the spread angle of the hollow 29 in consideration of the height of the heating chamber 2 (substantially the distance between the infrared detector 28 and the turntable 4), the minimum diameter of the food 10 to be heated on the turntable 4, etc., the detection range can be determined properly, that is, defined within the region of the food 10, so that only the infrared rays only from the food 10 may be allowed to be detected for accurate detection results.

If the detection range is limited to the region of the food 10 to be heated, as mentioned above, the intensity F of infrared rays applied to the infrared detector 28 will be given by $$F=\pi(r/a)^2dw/S.$$

Here, a: Length of the central axis of the hollow 29 of the horn member 27 along the longitudinal direction thereof, r: Radius of the hollow 29 on the opening side thereof, S: Light receiving area of the infrared detector 28, dw: Amount of infrared radiation per unit area of the food 10 to be heated.

As is evident from the above equation, the infrared ray intensity F does not depend on the distance b between the food 10 and the infrared detector 28, so that it is unnecessary, in this embodiment, to provide any correcting means based on the distance b. Namely, while the infrared ray intensity decreases in proportion to the square of the distance b, the dependence of the intensity F of infrared rays received upon the distance b is removed by utilizing such a principle that the detection area is increased in proportion to the square of the distance b.

If the height of the heating chamber 2 is 200 mm or thereabouts and the minimum diameter of the food 10 to be heated is 60 mm $\phi$, for example, then infrared rays emitted substantially only from the food 10 can be detected to provide high-accuracy detection results by setting the spread angle of the hollow 29 within a range of 4° to 10°.

Figure 5A:
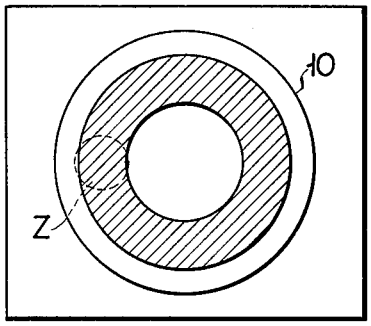
FIGS. 5A and 5B are diagrams for illustrating the detection range of the infrared detecting device.
Figure 5B:
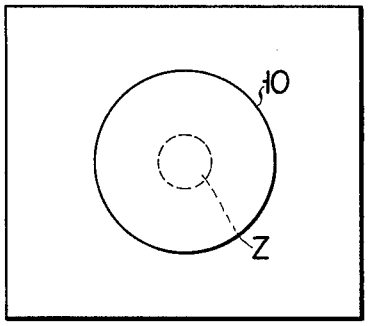

In a turntable type microwave oven, as shown in FIG. 5A, the state of the food 10 over a wide region thereof (hatched region) can be sensed as the table 4 rotates by setting the detection range Z within the movement region of the food 10. In a fixed-table type microwave oven, as shown in FIG. 5B, the detection region Z may be set substantially at the central portion of the food 10.

In the microwave oven incorporating the infrared detecting device 20 of the above-mentioned construction, moreover, the high-frequency shield member 31 of metal or other material is put on the surface of the horn member 27, and the minimum opening size of the horn member 27 is smaller than the wavelength of the microwaves emitted from the magnetron 11. As a result, the microwaves are prevented from entering the hollow 29 of the horn member 27. Thus, in the microwave oven of this invention, the infrared detecting operation will never be disturbed by the microwave from the magnetron. Effectively screened from the microwaves, in other words, the infrared detector 28 can correctly operate to ensure high-reliability and to provide high-accuracy detection data.

Figure 6:
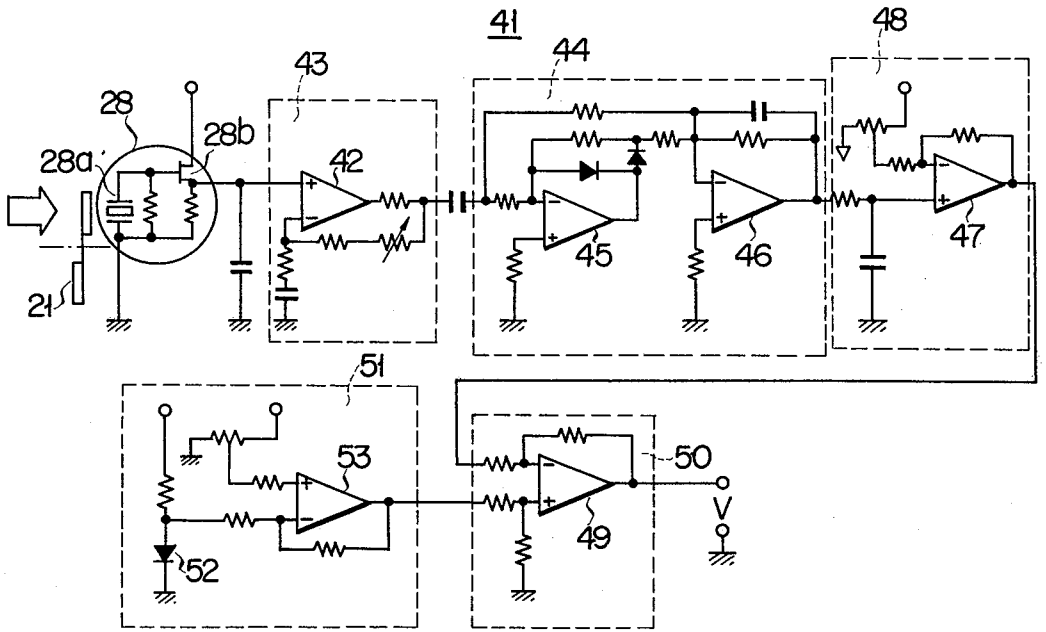
FIG. 6 is a circuit diagram of a detection signal processing circuit for processing detection signals incorporated in the microwave oven of FIGS. 1 to 3.

An output signal from the infrared detecting device 20 is applied to the input of the signal processing circuit 41 as shown in detail in FIG. 6. For ease of understanding, the light chopper 21 and the infrared detector 28 are incidentally shown along with the processing circuit 41 in FIG. 6.

The infrared detector 28 is composed of a photoelectric converter element **28*a* receiving infrared rays alternated by the chopper 21 and converting the rays into electric signals, a buffer amplifier 28*b* formed of an FET (field effect transistor) impedance-matching the output electric signals, and resistors. The photoelectric converter element 28*a*, buffer amplifier 28*b*, and resistors are usually integrated into a cell within a single semiconductor chip. An AC output from the infrared detector 28 is applied to the input of an amplifier circuit 43 including an operational amplifier 42 as its main component and resistors, and is amplified to a given level. The amplified signal is led into a full-wave rectifier circuit 44. The full-wave rectifier circuit 44, which is composed of operational amplifiers 45 and 46, feedback diodes therefor, feedback resistors, etc., full-wave-rectifies its input electric signal and produces a DC voltage signal corresponding to the amplitude level of the input signal. An output voltage signal from the rectifier circuit 44 is led to a DC amplifier circuit 48 including an operational amplifier 47 as its main component and resistors, where background noise and other factors included in the voltage signal are compensated for. The output signal from the DC amplifier circuit 48 is then applied to the inverted input terminal of an adder 50 including an operational amplifier 49** as its main component.

Further provided is a temperature sensing circuit 51 for sensing the temperature of the light chopper 21. The temperature sensing circuit 51, which is mainly composed of a diode 52 and an operational amplifier 53, utilizes the temperature characteristic involved in the forward-operation characteristic of the diode. The temperature of the light chopper 21 is detected as an electric signal by the diode 52. The detected electric signal is DC-amplified by the operational amplifier 53. The electric signal for the temperature sensed by the temperature sensing circuit 51 is applied to the non-inverted input terminal of the adder 50. The adder 50 works out and delivers the difference between the detection signal from the infrared detection device 20 applied to its inverted input terminal and the detection signal for the light chopper 21 applied to its non-inverted input terminal.

The difference signal delivered from the adder 50 represents the temperature of the food 10 being heated. Namely, the infrared detector 28 detects the infrared rays intermittently intercepted by the light chopper 21, so that its detection output V is $$V\propto\delta|\epsilon 1T1^4-\epsilon 2T2^4|.$$

Here,

δ: Stefan-Boltzmann number,

T1: Temperature of the food 10 being heated,

T2: Temperature of the light chopper 21, $\epsilon 1$: Infrared emissivity of the food 10, $\epsilon 2$: Infrared emissivity of the chopper 21.

Accordingly, the temperature of the food 10 can be obtained by adding by means of the adder 50 the temperature of the light chopper 21 sensed by the chopper temperature sensing circuit 51 to the detection output obtained by means of the infrared detecting device 20. The output signal of the adder 50 representing the temperature of the food 10 is converted into a digital code, indicated by the temperature indicator 7 on the front panel 5 of the main oven body 1, and supplied as a control signal to the magnetron 11.

Figure 7A:
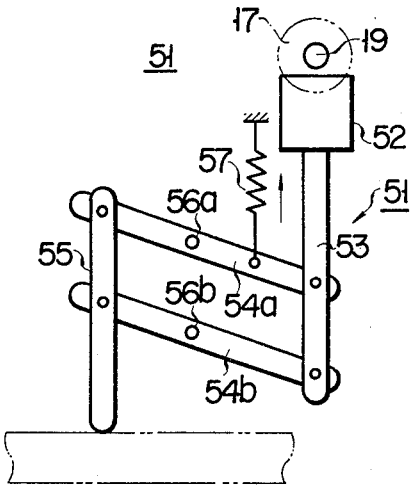
FIGS. 7A to 7C show a cleaning mechanism incorporated in the microwave oven of FIGS. 1 to 3.
Figure 7B:
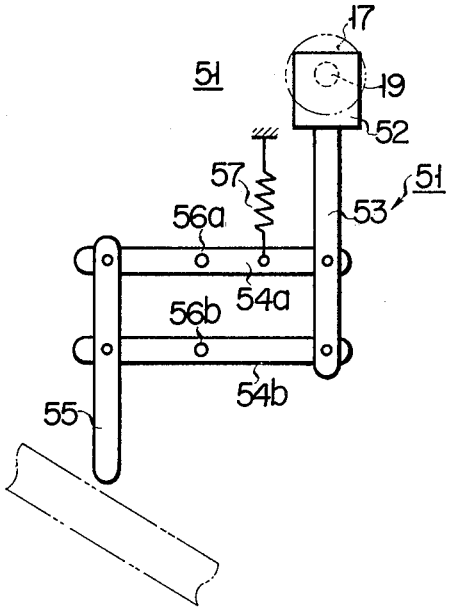
Figure 7C:
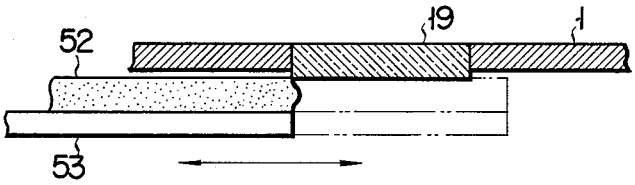

In the microwave oven of the invention, moreover, a cleaning mechanism 51 as shown in detail in FIGS. 7A to 7C is disposed near the infrared transmitting membrane 19, although shown only schematically in FIG. 1. The cleaning mechanism 51 is intended to clean that side of the infrared transmitting membrane 19 which faces the food 10.

A cleaning cloth 52, which is in slidable contact with the side of the membrane 19 facing the food 10, is moved on such side of the membrane 19 by a mechanism as mentioned later so as to wipe off dirt on the surface. The cleaning cloth 52 is attached to an end portion of a support lever 53. The support lever 53 is attached to one end portions of two parallel rocking levers 54*a* and 54*b*. The rocking levers 54*a* and 54*b* are fitted with a control lever 55 at their respective other end portions and rockably fixed by pins 56*a* and 56*b* at the middle portions, respectively. The rocking levers 54*a* and 54*b* can rock around the pins 56*a* and 56*b*, respectively. The rocking lever 54*a* is pulled by a spring 57 in the direction of an arrow in FIG. 7A. The control lever 55 is actuated by the opening or closing of the door 3 of the main oven body 1. When the door 3 is closed, the control lever 55 is pressed by the inside wall of the door 3 against the biasing force of the spring 57, and is thrusted into the inner part of the main oven body 1. Thereupon, the rocking levers 54*a* and 54*b* rock around the pins 56*a* and 56*b*, respectively, so that the support lever 53 moves in a direction opposite to the moving direction of the control lever 55. Accordingly, the cleaning cloth 52 is set in a position separated from the transmitting membrane 19, as shown in FIG. 7A. When the door 3 is opened, on the other hand, the control lever 55 is released from the push of the door 3, and the rocking levers 54*a* and 54*b* rock in a direction opposite to the aforesaid direction by means of the biasing force of the spring 57. As a result, the support lever 53 slides toward the membrane 19, and the cleaning cloth 52 attached to the tip end of the support lever 53 moves on the membrane 19, thereby cleaning the membrane 19. Since the cleaning cloth 57 moves every time the door 3 is opened or closed, soil on the transmitting membrane 19 may be removed accompanying the action of the door 3, as shown in FIG. 7C. Thus, the transmitting membrane 19 is always kept clean, so that attenuation of the infrared rays incident upon the infrared detecting device 20 may be avoided. Accordingly, even prolonged use of the microwave oven will never reduce the detection accuracy of the detecting device. Further, replacement of the cleaning cloth 52 at suitable intervals or according to the degree of contamination will be able to maintain high cleaning effect for a long time. As for the cleaning mechanism 51, it may enjoy easy maintenance and handling since its cleaning effect can be increased by only replacing the cleaning cloth 52.

The use of the cleaning mechanism 51, simple in construction and capable of easy maintenance, enables accurate detection of infrared rays, preventing overheating of the food 10 to ensure effective operation of the microwave oven.

In the microwave oven of this invention, as described above, the infrared detecting device 20 is composed of the horn member 27 having the hollow 29 which has the opening diameter increasing toward the food 10 being heated and the minimum opening size smaller than the wavelength of microwaves, and the infrared detector 28 to detect infrared rays condensed by means of the hollow 29 of the horn member 27. Accordingly, the detection range can be set within a proper range by setting the spread angle of the hollow 29 at a given angle. Thus, infrared rays applied from outside the set range can be outwardly returned and prohibited from being applied to the infrared detector 28 so that only the infrared rays from within the set range may be detected without being affected by the microwaves emitted from the magnetron, thereby providing high-accuracy detection results.

Further, the horn member 27 is composed of the plastic horn body 30 and the high-frequency shield member 31 covering the surface of the horn body 30. The plastic horn body 30 can easily be manufactured with high-accuracy by injection molding, and the high-frequency shield member 31 can easily be finished specularly by plating or other processing, which leads to facilitation of the manufacture of the horn member 27.

Furthermore, the stirrer fan 14 is provided in the vicinity of the antenna opening 12*a* in the top wall of the heating chamber 2 to stir the microwaves emitted from the magnetron 11 and introduced into the heating chamber 2 so that the microwaves may be radiated to every corner of the heating chamber 2. Thus, the food 10 being heated may entirely be heated without unevenness.

Additionally, the air conduit 15 is provided at the top portion of the heating chamber 2, and the blower fan 17 is disposed in the air conduit 15 so that the outside air may be introduced into the heating chamber 2 through the air conduit 15. Accordingly, an airstream flowing from the air inlet 16 at the top of the heating chamber 2 toward the exhaust port 18 at the lower portion of the chamber is created inside the chamber. By such airstream, steam, oil, soil, etc. delivered from the food 10 being heated may be quickly discharged through the exhaust port 18 without stagnating within the heating chamber 2. Therefore, the infrared rays emitted from the food 10 will never be absorbed by the steam, and the oil, soil and other waste materials will be prevented from sticking to the infrared transmitting membrane 19 to attenuate the transmission of infrared rays. Thus, the temperature detection may be performed with high-reliability and high-accuracy.

Moreover, the infrared transmitting membrane 19 is cleaned in response to the opening and closing of the door 3 in the use of the microwave oven, so that it can always have a clean surface. As a result, even prolonged use of the microwave oven will never reduce the detection accuracy.

Further, the cleaning effect may be increased by replacing the cleaning cloth 52 according to the degree of contamination, so that the infrared detection accuracy may be maintained high and stable for a long period of time. In addition, maintenance of the microwave oven including the replacement, etc. is easy.

It is to be understood that this invention is not limited to the above-mentioned embodiment. For example, the cleaning mechanism may be a cam mechanism interlocking with the shaft of the door 3 to move a cleaning member. Alternatively, the cleaning mechanism may be operated electrically in response to the action of the door 3 by an electrical means. The cleaning effect may further be increased by suitably selecting the material and structure of the cleaning cloth or by replacing the same. In the manufacture of the horn member 27, moreover, two horn elements of duplicate structure may be oppositely joined together. The shape of the hollow 29 of the horn member 27 is not limited to the conical configuration, and may also be paraboloidal, for example.

That is, various changes and modifications may be effected by one skilled in the art without departing from the scope or spirit of the invention.

What we claim is:

1. A microwave oven comprising:

a magnetron for emitting microwaves;

a heating chamber body for holding food being heated by microwaves from the magnetron, an infrared ray transmitting section provided in the top wall of said heating chamber body for transmitting infrared rays emitted from the food;

infrared ray detecting means disposed over said infrared ray transmitting section and comprising a horn member and an infrared ray detecting element, said horn member being made of material capable of cutting off microwaves and having a hollow extending toward said heating chamber body into which infrared rays are applied from the food and said infrared ray detecting element being so positioned as to detect infrared rays condensed by said hollow, said hollow having a diameter increasing toward said heating chamber body and a minimum opening size smaller than the wavelength of microwaves and having a spread angle so set that only infrared rays emitted from the food may be allowed to reach said infrared ray detecting element and that infrared rays emitted from other regions than said food may be returned after repreated reflection within said hollow without being applied to said infrared ray detecting element; and a processing circuit for calculating the temperature of said food on the basis of a detection signal from said infrared ray detecting means.

2. A microwave oven according to claim 1, wherein said hollow of said horn member is in the shape of a truncated cone.

3. A microwave oven according to claim 1, wherein said hollow of said horn member is in the shape of a paraboloid.

4. A microwave oven according to claim 1, wherein the spread angle of said hollow of said horn member is so set as to correct the infrared ray intensity which decreases in proportion to the square of the distance between said infrared detecting means and said food being heated.

5. A microwave oven according to claim 2, wherein the height of said heating chamber body is approximately 200 mm, and the spread angle of said hollow is within a range of 4° to 10°.

6. A microwave oven according to claim 1, wherein said horn member is composed of a horn body formed of synthetic resin and a high-frequency shield member formed all over the surface of said horn body.

7. A microwave oven according to claim 6, wherein said synthetic resin is acrylonitrile-butadiene-stryrene copolymer resin.

8. A microwave oven according to claim 6, wherein said high-frequency shield member is a metal film.

9. A microwave oven according to claim 1, wherein said infrared detecting element is disposed inside a recess formed in said horn member, the opening side of said recess being fitted with a cover member for preventing the microwaves from said magnetron from being applied to said infrared detecting element.

10. A microwave oven according to claim 1 further comprising stirring means for stirring the microwaves emitted from said magnetron, whereby said microwaves will be radiated uniformly in said heating chamber body.

11. A microwave oven according to claim 10, wherein said stirring means is in the form of a fan driven by a motor.

12. A microwave oven according to claim 1 further comprising a cleaning mechanism for cleaning said infrared transmitting section formed in said heating chamber body.

13. A microwave oven according to claim 12, wherein said cleaning mechanism consists of mechanical means operating in conjunction with the opening or closing of a door of said heating chamber body and means moving on said infrared transmitting section while wiping said section as said mechanical means operates.

14. A microwave oven according to claim 13, wherein said mechanical means includes a cam mechanism.

15. A microwave oven according to claim 1 further comprising means for generating an airstream to flow through said heating chamber body.

16. A microwave oven according to claim 15, wherein said airstream generating means includes an air conduit defined by the top wall of said heating chamber body and opening into said heating chamber body, an exhaust port formed in at least one side wall of said heating chamber body, and blower means for introducing the open air into said heating chamber body through said air conduit.

* * * * *